US005600911A

United States Patent [19]

Lucci

[11] Patent Number: 5,600,911

[45] Date of Patent: Feb. 11, 1997

[54] MARKABLE TABLE COVER

[76] Inventor: Martin T. Lucci, 104 Spartan Ave., Staten Island, N.Y. 10303

[21] Appl. No.: 494,387

[22] Filed: Jun. 26, 1995

[51] Int. Cl.[6] ..... A47B 97/00

[52] U.S. Cl. ..... 40/611; 40/661; 108/90; 108/25

[58] Field of Search ..... 40/320, 644, 661, 40/358, 611, 326; 108/23, 25, 90

[56] References Cited

U.S. PATENT DOCUMENTS 1,489,113 4/1924 Brookbank ..... 40/320

2,711,786 6/1955 Weiss ..... 40/320 X 5,397,162 3/1994 Haung ..... 40/320 X

FOREIGN PATENT DOCUMENTS 2276649 1/1976 Germany ..... 40/320

*Primary Examiner*—Brian K. Green

*Assistant Examiner*—Cassandra Davis

[57] ABSTRACT

A cover for receiving and displaying written indicia relative to a table surface. The structure includes a cover structure for positioning over a table. A writing substrate is received between the cover and the table and can be written on to display customized messages through the cover.

5 Claims, 3 Drawing Sheets

MARKABLE TABLE COVER

BACKGROUND OF THE INVENTION

1. Field of the Invention

The present invention relates to covering structures and more particularly pertains to an markable table cover for receiving and displaying indica relative to a table surface.

2. Description of the Prior Art

The use of covering structures is known in the prior art. More specifically, covering structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art covering structures include U.S. Pat. No. 3,785,419; U.S. Pat. No. 3,825,050; U.S. Pat. No. 4,542,050; U.S. Pat. No. 5,084,321; and U.S. Pat. No. 294,443.

While these devices fulfill their respective, particular objectives and requirements, the aforementioned patents do not disclose a markable table cover for receiving and displaying written indica relative to a table surface which includes a cover for positioning over a table, and a writing substrate received between the cover and the table which can be written to display customized messages through the cover.

In these respects, the markable table cover according to the present invention substantially departs from the conventional concepts and designs of the prior art, and in so doing provides an apparatus primarily developed for the purpose of receiving and displaying written indica relative to a table surface.

SUMMARY OF THE INVENTION

In view of the foregoing disadvantages inherent in the known types of covering structures now present in the prior art, the present invention provides a new markable table cover construction wherein the same can be utilized for receiving and displaying written indica relative to a table surface. As such, the general purpose of the present invention, which will be described subsequently in greater detail, is to provide a new markable table cover apparatus and method which has many of the advantages of the covering structures mentioned heretofore and many novel features that result in a markable table cover which is not anticipated, rendered obvious, suggested, or even implied by any of the prior art covering structures, either alone or in any combination thereof.

To attain this, the present invention generally comprises a cover for receiving and displaying written indicia relative to a table surface. The inventive device includes a cover for positioning over a table. A writing substrate is received between the cover and the table and can be written on to display customized messages through the cover.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new markable table cover apparatus and method which has many of the advantages of the covering structures mentioned heretofore and many novel features that result in a markable table cover which is not anticipated, rendered obvious, suggested, or even implied by any of the prior art covering structures, either alone or in any combination thereof.

It is another object of the present invention to provide a new markable table cover which may be easily and efficiently manufactured and marketed.

It is a further object of the present invention to provide a new markable table cover which is of a durable and reliable construction.

An even further object of the present invention is to provide a new markable table cover which is susceptible of a low cost of manufacture with regard to both materials and labor, and which accordingly is then susceptible of low prices of sale to the consuming public, thereby making such markable table covers economically available to the buying public.

Still yet another object of the present invention is to provide a new markable table cover which provides in the apparatuses and methods of the prior art some of the advantages thereof, while simultaneously overcoming some of the disadvantages normally associated therewith.

Still another object of the present invention is to provide a new markable table cover for receiving and displaying written indica relative to a table surface.

Yet another object of the present invention is to provide a new markable table cover which includes a cover for positioning over a table, and a writing substrate received between the cover and the table which can be written to display customized messages through the cover.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
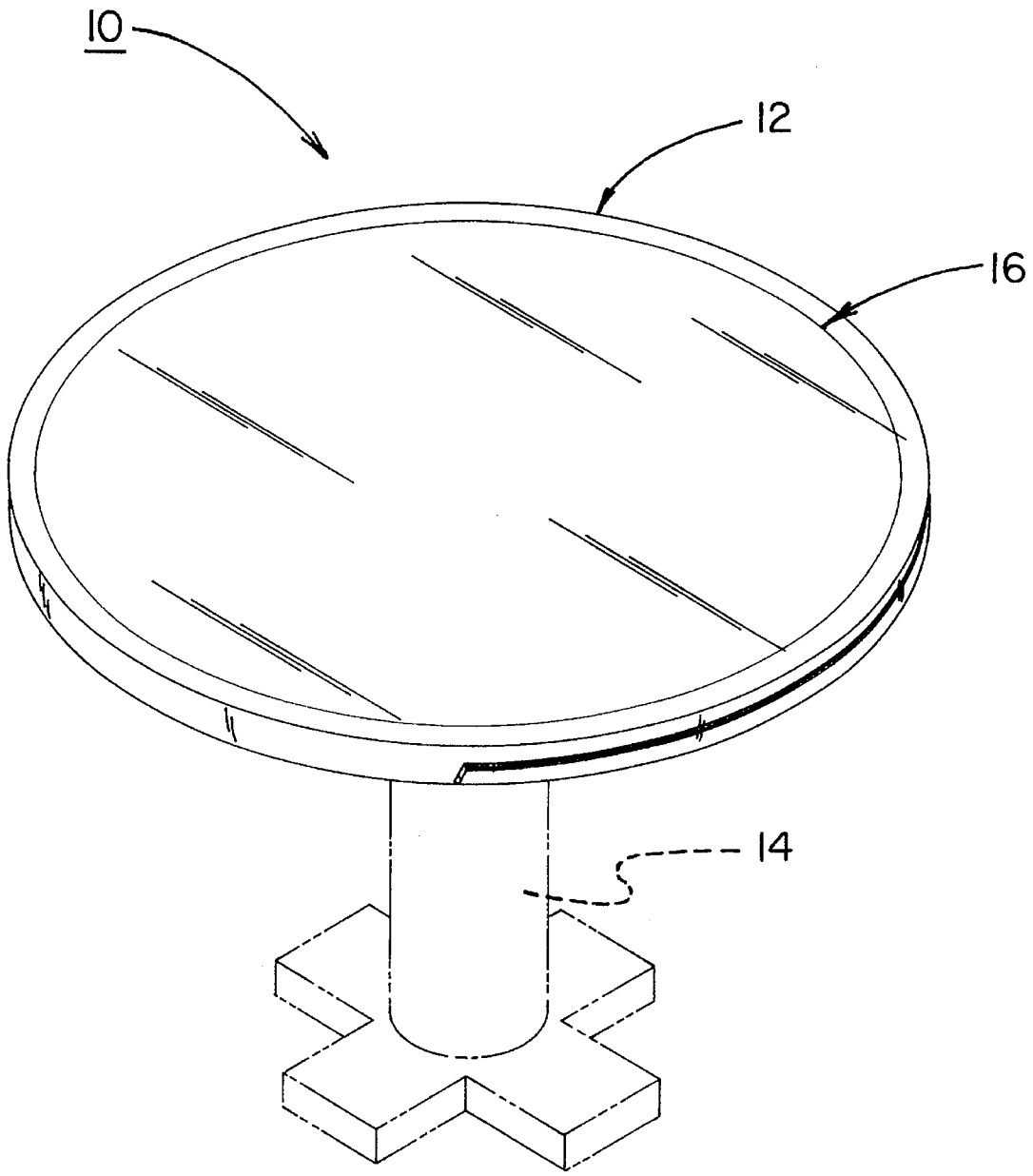
FIG. 1 is an isometric illustration of a markable table cover according to the present invention in use.
Figure 2:
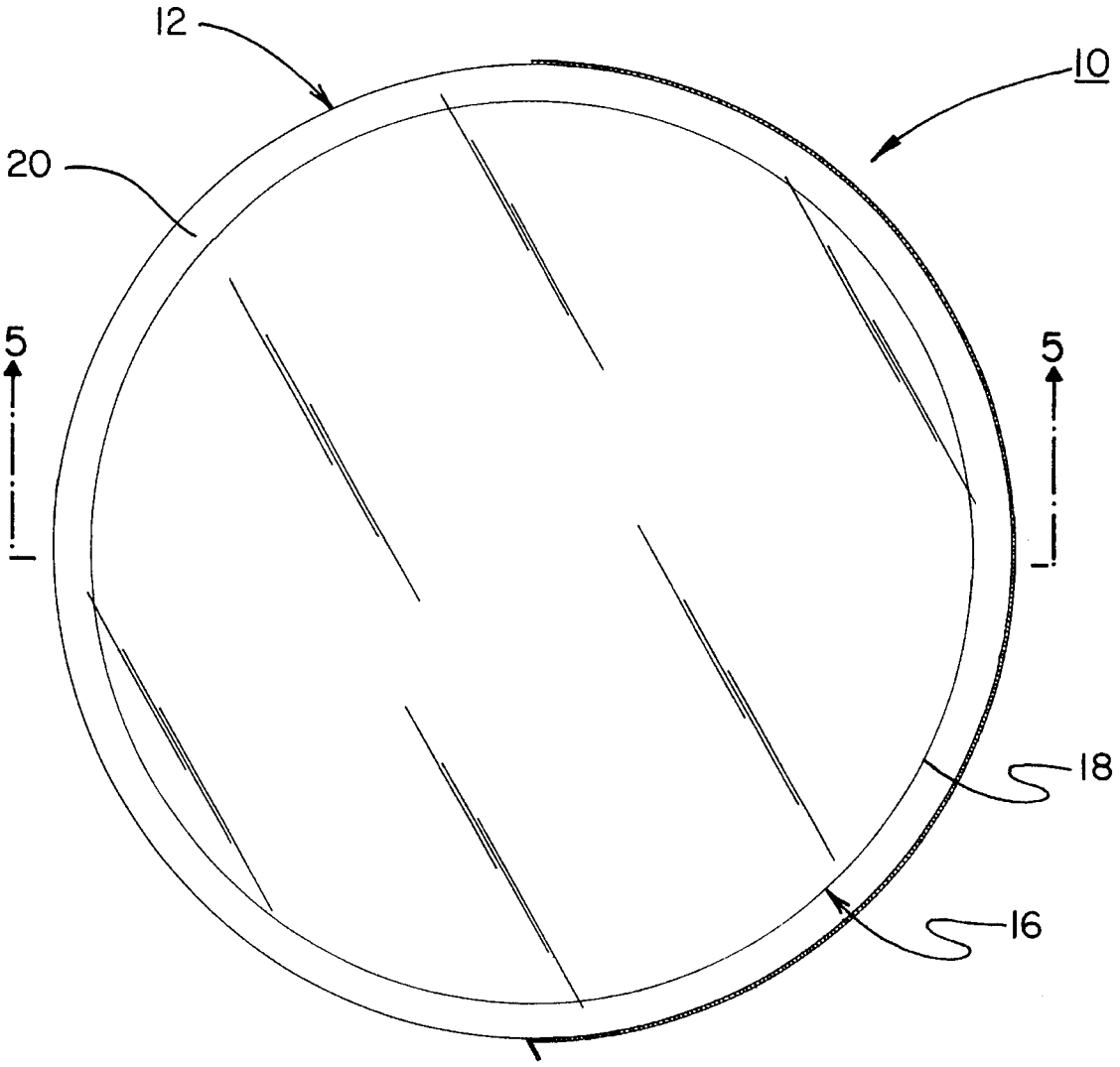
FIG. 2 is a top plan view of the invention.

With reference now to the drawings, and in particular to FIGS. 1–5 thereof, a new markable table cover embodying the principles and concepts of the present invention and generally designated by the reference numeral 10 will be described.

More specifically, it will be noted that the markable table cover 10 comprises a cover means 12 for positioning over an unlabeled table top of a table 14 substantially as shown in FIG. 1 of the drawings. A substrate means 16 is positioned beneath cover means 12 and oriented so as to reside between the cover means and the table top of the table 14 when installed thereto and operates for receiving indica to be displayed through cover means 12. By this structure, the substrate means 16 can be selectively marked upon, whereby such markings can be viewed through the cover means 12 during use of the table 14.

Figure 4:
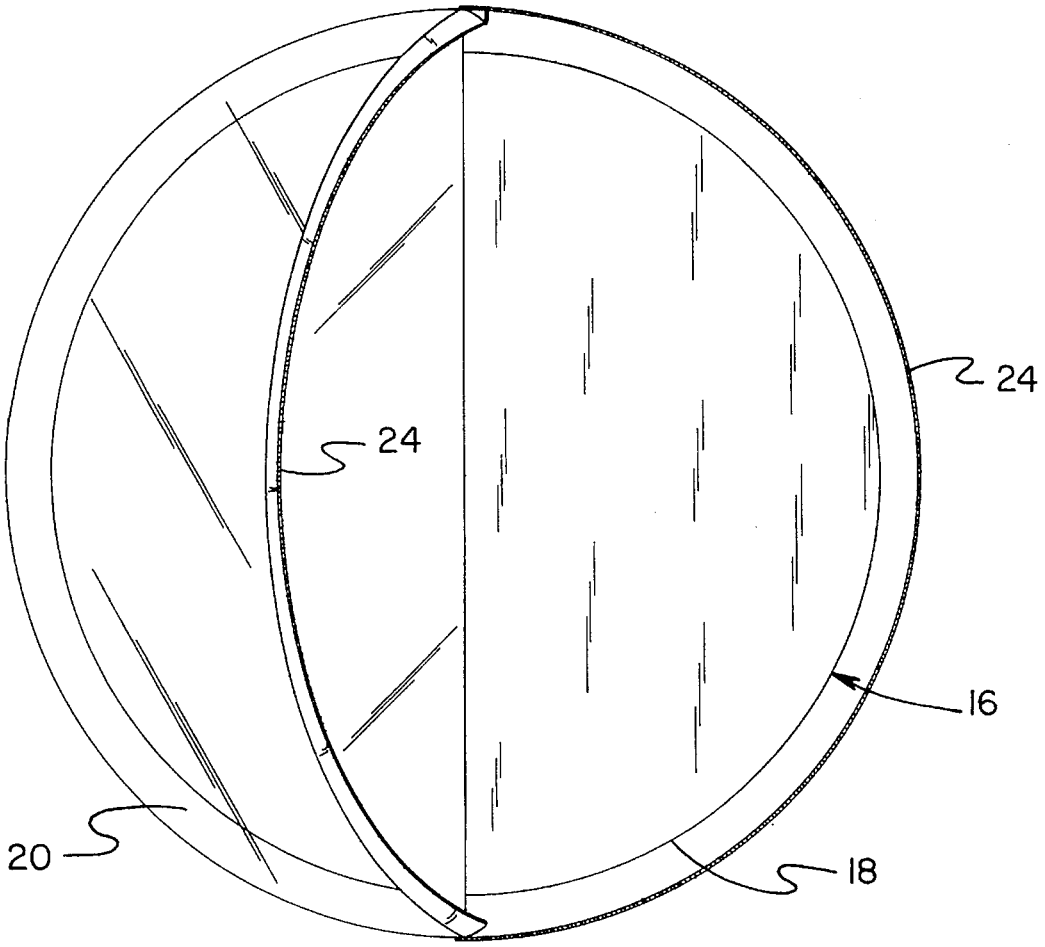
FIG. 4 is a top plan view of the invention in an open configuration.
Figure 5:
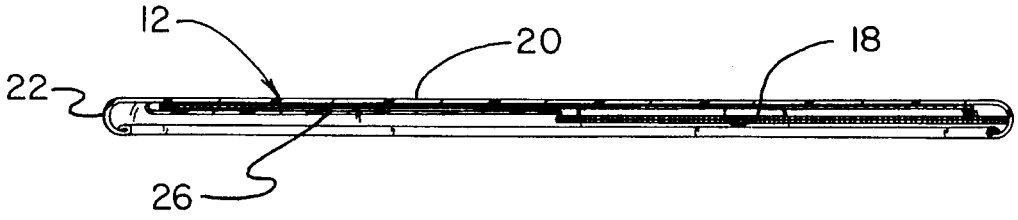
FIG. 5 is a cross sectional view taken along line 5—5 of FIG. 2.

As best illustrated in FIGS. 4 and 5, it can be shown that the writing substrate means 16 according to the present invention 10 preferably comprises a paper web 18 suitable for receiving marks from an ink pen, a marker, a pencil, or other writing means. The paper web 18 is shaped so as to fit within the cover means 12 such that customized indica applied to the paper web 18 can be viewed therethrough.

Figure 3:
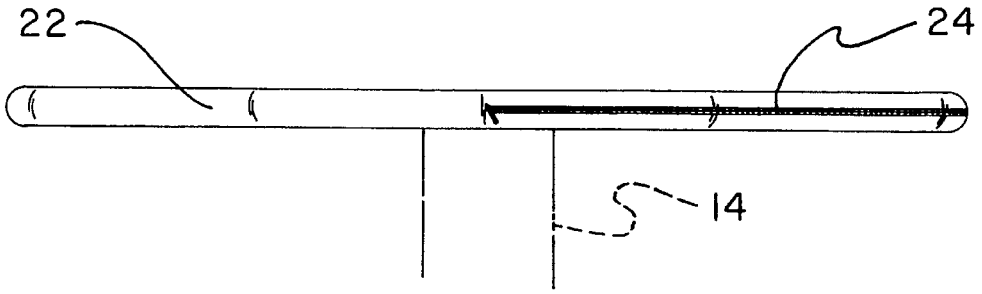
FIG. 3 is a side elevation view thereof.

As shown in FIGS. 2 through 5, the cover means 12 according to the present invention 10 preferably comprises a cover web 20 having a shape substantially corresponding to a shape of the table top of the table 14 to which the device 10 is to be associated. In the exemplary embodiment of the present invention 10, the cover web 20 of the cover 12 is substantially circular in shape. However, it is within the intent and purview of the present invention for the cover web 20 to shaped as a rectangle, ovoid, or other geometric shape as desired so as to coextensively cover a table top of a table 14. As shown in FIG. 3, a side wall web 22 depends from a perimeter of the cover web 20 for placement about the table top of the table 14. A zipper 24 is interposed between a portion of the cover web 20 and the side wall web 22 and can be selectively unzipped to permit a portion of the cover web 20 to be opened as illustrated in FIG. 4 of the drawings. Preferably, the zipper 24 extends around approximately one-half of a perimeter of the cover web 20. By this structure, the cover web 20 can be selectively released from the side wall web 22 to facilitate access to the paper web 18 of the writing substrate means 16 to permit an individual to write customized indica thereon.

To retain the writing substrate means 16 relative to the cover means 12 during periods of non-use of the device 10 and to align the paper web 18 relative to the cover web 20 during use of the device, the cover means 12 may further comprise a pocket web 26, as shown in FIG. 5, which is coupled to a bottom surface of the cover web 20 and extends in a substantially spaced and parallel orientation relative thereto. By this structure, the paper web 18 can be positioned between the pocket web 26 and the cover web 20 so as to be aligned with the cover web 20. Preferably, the pocket web 26 is substantially semi-circular in shaped for use with the exemplary embodiment shown in the drawings, or alternatively, the pocket web 26 is shaped so as to resemble one-half the cover web 20. By this structure, the pocket web 26 extends across a first half of the cover web 20, with the zipper 24 extending along the perimeter of a second half of the cover web 20.

In use, the markable table cover 10 according to the present invention can be easily utilized for receiving and displaying written indica relative to a table surface. The paper web 18 of the writing substrate means 16 can be selectively marked upon by a user and rotated within the pocket web 26 so as to expose various portions thereof. The cover web 20 serves to permit viewing of the writing substrate means 16 during use of the table 14 and to protect the substrate means 16 from damage.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A markable table cover comprising:

a clear cover means for positioning over a top of an article of furniture, wherein the cover means comprises a cover web having a shape adapted to substantially corresponding to a shape of a top of an article of furniture to which the markable table cover is to be associated; a side wall web depending from a perimeter of the cover web for placement about a top of an article of furniture; and a zipper interposed between a portion of the cover web and the side wall web for selectively permitting a portion of the cover web to be opened from the side wall web;

a substrate means positioned beneath the cover means and oriented so as to be positionable between the clear cover means and a top of an article of furniture for receiving indicia to be displayed through the cover means, said substrate means comprising a flexible material suitable for receiving marks from a writing instrument, the flexible material being shaped so as to fit within the cover means such that customized indicia applied to the flexible material can be viewed therethrough.

2. The markable table cover of claim 1, wherein the zipper extends around approximately one-half of the perimeter of the cover web.

3. The markable table cover of claim 2, wherein the cover means further comprises a pocket web coupled to a bottom surface of the cover web and extending in a substantially spaced and parallel orientation relative thereto, with the flexible material being positioned between the pocket web and the cover web.

4. The markable table cover of claim 3, wherein the pocket web is shaped so as to resemble one-half of the cover web such that the pocket web extends across a first half of the cover web.

5. The markable table cover of claim 4, wherein the zipper extends along the perimeter of a second half of the cover web.

* * * * *